US008953991B2

(12) United States Patent
Ueno et al.

(10) Patent No.: US 8,953,991 B2
(45) Date of Patent: Feb. 10, 2015

(54) FIXING DEVICE AND IMAGE FORMING APPARATUS

(75) Inventors: Satoshi Ueno, Tokyo (JP); Tadashi Ogawa, Tokyo (JP); Takeshi Uchitani, Kanagawa (JP); Teppei Kawata, Kanagawa (JP); Takamasa Hase, Tokyo (JP); Kazuya Saito, Kanagawa (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 222 days.

(21) Appl. No.: 13/371,985

(22) Filed: Feb. 13, 2012

(65) Prior Publication Data

US 2012/0207523 A1 Aug. 16, 2012

(30) Foreign Application Priority Data

Feb. 16, 2011 (JP) ..... 2011-030624

(51) Int. Cl.
*G03G 15/20* (2006.01)

(52) U.S. Cl.
CPC ..... *G03G 15/2028* (2013.01)
USPC ..... 399/323; 399/122

(58) Field of Classification Search
CPC ..... G03G 15/6573; G03G 15/6576; G03G 15/2028
USPC ..... 399/323, 328–331
See application file for complete search history.

(56) References Cited

U.S. PATENT DOCUMENTS 7,266,336 B2 9/2007 Ueno et al.
7,450,872 B2 11/2008 Ueno et al.
7,491,917 B2 2/2009 Ueno
7,509,085 B2 3/2009 Yoshinaga et al.
7,693,439 B2 4/2010 Seo et al.
7,715,774 B2 5/2010 Ueno (Continued)

FOREIGN PATENT DOCUMENTS

JP 63-085679 4/1988
JP 2005-037567 2/2005

(Continued)

OTHER PUBLICATIONS

JP OA issued Oct. 21, 2014 in Japanese Application No. JP 2011-030624.

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

A fixing device includes a fixing member configured to heat and fix a toner image onto a recording medium; a pressurizing member configured to press a heating member, which is used for heating the fixing member, against the fixing member and form a fixing nip part; and a guide member configured to guide the recording medium away from the fixing member and the pressurizing member at a downstream side of the fixing member or the pressurizing member in a conveying direction of the recording medium. The guide member includes a pushing unit for maintaining a relative positional relationship between the guide member and an outer peripheral surface of the fixing member or the pressurizing member, and the pushing unit is provided in a manner as to follow surface characteristics of outer peripheral parts of the fixing member or the pressurizing member where the pushing unit pushes.

7 Claims, 11 Drawing Sheets

(56) References Cited

U.S. PATENT DOCUMENTS

| | | | | |
|---|---|---|---|---|
| 7,734,208 | B2 | 6/2010 | Seo et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 7,925,177 | B2 | 4/2011 | Ishii et al. | |
| 7,983,582 | B2 | 7/2011 | Hase | |
| 8,014,711 | B2 | 9/2011 | Ito et al. | |
| 2007/0014600 | A1 | 1/2007 | Ishii et al. | |
| 2007/0116498 | A1* | 5/2007 | Nakano et al. | 399/323 |
| 2007/0134034 | A1* | 6/2007 | Kitami et al. | 399/328 |
| 2007/0280754 | A1 | 12/2007 | Ogawa et al. | |
| 2009/0245897 | A1 | 10/2009 | Seo et al. | |
| 2010/0014903 | A1 | 1/2010 | Seto et al. | |
| 2010/0061753 | A1 | 3/2010 | Hase | |
| 2010/0158553 | A1 | 6/2010 | Ueno | |
| 2010/0232844 | A1 | 9/2010 | Saito et al. | |
| 2010/0239292 | A1 | 9/2010 | Fujita et al. | |
| 2010/0303521 | A1 | 12/2010 | Ogawa et al. | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052277 | A1 | 3/2011 | Ueno et al. | |
| 2011/0058862 | A1 | 3/2011 | Yamaguchi et al. | |
| 2011/0058863 | A1 | 3/2011 | Shinshi et al. | |
| 2011/0064443 | A1 | 3/2011 | Iwaya et al. | |
| 2011/0064490 | A1 | 3/2011 | Imada et al. | |
| 2011/0064502 | A1 | 3/2011 | Hase et al. | |
| 2011/0085832 | A1 | 4/2011 | Hasegawa et al. | |
| 2011/0091253 | A1 | 4/2011 | Seo et al. | |
| 2011/0097121 | A1* | 4/2011 | Yamamoto et al. | 399/323 |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0176821 | A1 | 7/2011 | Hase | |
| 2011/0176822 | A1 | 7/2011 | Ishii et al. | |
| 2011/0182638 | A1 | 7/2011 | Ishii et al. | |
| 2011/0194869 | A1 | 8/2011 | Yoshinaga et al. | |
| 2011/0194870 | A1 | 8/2011 | Hase et al. | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0217056 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222926 | A1 | 9/2011 | Ueno et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229161 | A1 | 9/2011 | Ueno et al. | |
| 2011/0229162 | A1 | 9/2011 | Ogawa et al. | |
| 2011/0229178 | A1 | 9/2011 | Ogawa et al. | |
| 2011/0229180 | A1 | 9/2011 | Saito | |
| 2011/0229181 | A1 | 9/2011 | Iwaya et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0293309 | A1 | 12/2011 | Hase | |
| 2011/0311284 | A1 | 12/2011 | Seo et al. | |

FOREIGN PATENT DOCUMENTS

| | | |
|---|---|---|
| JP | 2006-098903 | 4/2006 |
| JP | 2007-024948 | 2/2007 |
| JP | 2009-128575 | 6/2009 |
| JP | 2010-79219 | 4/2010 |

* cited by examiner

FIXING DEVICE AND IMAGE FORMING APPARATUS

BACKGROUND OF THE INVENTION

1. Field of the Invention

The present invention relates to a fixing device and an image forming apparatus configured to fix a toner image on a recording medium by passing the recording medium, on which an image has been transferred, between a fixing member and a pressurizing member.

2. Description of the Related Art

In recent years, with the advancement in development of image forming apparatuses such as printers, copiers, and fax machines, there has been increasing demand for power saving and high speed. To meet this demand, it is important to improve the thermal efficiency of the fixing device used in the image forming apparatus.

In an image forming apparatus, an unfixed toner image is formed by an image forming process such as electrophotographic recording, electrostatic recording, and magnetic recording. The unfixed toner image is formed on a recording medium such as a recording sheet, a printing sheet, a photosensitive sheet, and an electrostatic recording sheet, by an image transfer method or a direct method. As the fixing device for fixing the unfixed toner image, a contact heating type fixing device is widely used, which uses a heat roller method, a film heating method, an electromagnetic induction heating method, etc.

A fixing device using the heat roller method has a basic configuration including a rotational roller pair formed by a fixing roller and a pressurizing roller that is held together via pressure contact with the fixing roller. In the fixing roller, a heat source such as a halogen lamp is provided, so that the fixing roller is adjusted to have a predetermined temperature. The recording material is guided into and conveyed by the contact part, i.e., a fixing nip part, between the two rollers of the rotational roller pair. Accordingly, the unfixed toner image is fused and then fixed by the heat and pressure from the fixing roller and the pressurizing roller (see, for example, patent documents 1 and 2).

In a fixing device using the film heating method, the recording material is brought into close contact with a heating body fixed to a supporting member, via a thin, heat resistant fixing film. The heat of the heating body is supplied to the recording material via the fixing film while sliding the fixing film against the heating body. In the fixing device, a ceramic heater is used as the heating body. The ceramic heater includes a resistance layer placed on a ceramic substrate made of a material such as alumina and aluminum nitride, having heat resistant properties, insulation properties, highly thermally-conductive properties, etc. This fixing device can use a thin fixing film having a low thermal capacity. Therefore, this fixing device has higher heat transfer efficiency than the fixing device using the heat roller method. Accordingly, with this fixing device, the warm-up time is reduced, so that quick start and power saving can be achieved.

In a fixing device using the electromagnetic induction heating method, an eddy current is induced to a metal layer (heat generating layer) of a fixing sleeve by magnetic flux, and Joule heat is generated by the eddy current.

In the fixing device using the electromagnetic induction heating method, a direct fixing film is caused to generate heat by using an inductive current. With this fixing device, it is possible to perform a fixing process with higher efficiency than that of a fixing device using the heat roller method using a halogen lamp as the heat source.

A well-known configuration of a fixing device using the electromagnetic induction heating method includes a fixing sleeve having a release layer, an elastic layer, and a metal layer (heat generating layer). Inside the fixing sleeve, a fixing roller is provided, which is formed of an elastic layer and a supporting member (core). The fixing roller and a pressurizing roller are brought into pressure contact with each other via the fixing sleeve to form a pressure contact nip part.

In this configuration, the fixing sleeve is prevented from moving in the thrust direction by being adhered to the fixing roller with a silicone adhesive. When the fixing sleeve is not adhered to the fixing roller, a ring having a larger diameter than the fixing sleeve is provided at the end of the fixing roller to prevent the fixing sleeve from moving.

In the device described in patent document 2, the toner image is fixed onto the recording material at the fixing nip part formed by the fixing roller and the pressurizing roller. This recording material may be wound around the fixing roller or the pressurizing roller due to the viscosity of the toner that has been fused but not yet cooled, or due to the direction of the fixing nip. Thus, in order to properly guide the recording material to the correct conveying path, a separating member has been used in the conventional technology.

In the past, a contact type claw has been used as a separating member. However, in full-color images, claw marks created on the roller appear in the images. Therefore, in recent years, a non-contact type separating plate is widely used. In the non-contact method, it is important to manage the separation gap. Therefore, a metal sheet is typically used as the non-contact separating plate to achieve the required positioning precision. Furthermore, a sheet-type separating plate is used instead of a claw, to prevent the image quality from deteriorating due to rubbing the recording material.

Furthermore, to precisely form the separation gap between the recording material and the roller, a pushing part is provided at an end part outside the range of the image. The pushing part may be combined with the separating plate or formed separately from the separating plate. By pushing the pushing part against the roller, the separation gap is formed.

As described above, in recent fixing devices, in order to achieve power saving, it is important to rapidly heat the fixing device to quickly reach a standby status. For this purpose, even in fixing devices included in image forming apparatuses used for mass production, rollers of small diameters are used to reduce the heat capacity. In this case, with respect to the linear speed, the separating plate/pushing part slides against the same part of the roller many times.

Furthermore, as the roller is rapidly heated, the thermal expansion of the roller may not occur in a uniform manner in the longitudinal direction, particularly immediately after activation or after sheets of small sizes have continuously passed through the rollers. Generally, the center part of the roller in the longitudinal direction becomes larger than the end parts, and the roller tends to become shaped like a drum. Thus, it may become difficult to push the pushing part of the separating plate against the outer periphery of the roller by a uniform force in the longitudinal direction. Accordingly, the pushing part may only push the end parts of the drum-shaped roller in the width direction.

Furthermore, in the case of the electromagnetic induction heating method, a fixing sleeve having a metal layer is used, and therefore the pushing part pushes against the outer periphery of the roller that is harder than a conventional fixing roller. Due to the above reasons, in fixing devices, the surface of the fixing roller tends to be damaged by the separating plate/pushing part.

Patent Document 1: Japanese Laid-Open Patent Publication No. 2010-79219

Patent Document 2: Japanese Laid-Open Patent Publication No. 2009-128575

SUMMARY OF THE INVENTION

The present invention provides a fixing device and an image forming apparatus, in which one or more of the above-described disadvantages are eliminated.

According to an aspect of the present invention, there is provided a fixing device including a fixing member configured to heat a toner image on a recording medium and fix the toner image onto the recording medium; a pressurizing member configured to press a heating member, which is used for heating the fixing member, against the fixing member and form a fixing nip part; and a guide member configured to guide the recording medium away from the fixing member and the pressurizing member at a downstream side of the fixing member or the pressurizing member in a conveying direction of the recording medium, wherein the guide member includes a pushing unit for maintaining a relative positional relationship between the guide member and an outer peripheral surface of the fixing member or the pressurizing member, and the pushing unit is provided in a manner as to follow surface characteristics of outer peripheral parts of the fixing member or the pressurizing member where the pushing unit pushes.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Overall Configuration of Image Forming Apparatus

Figure 1:
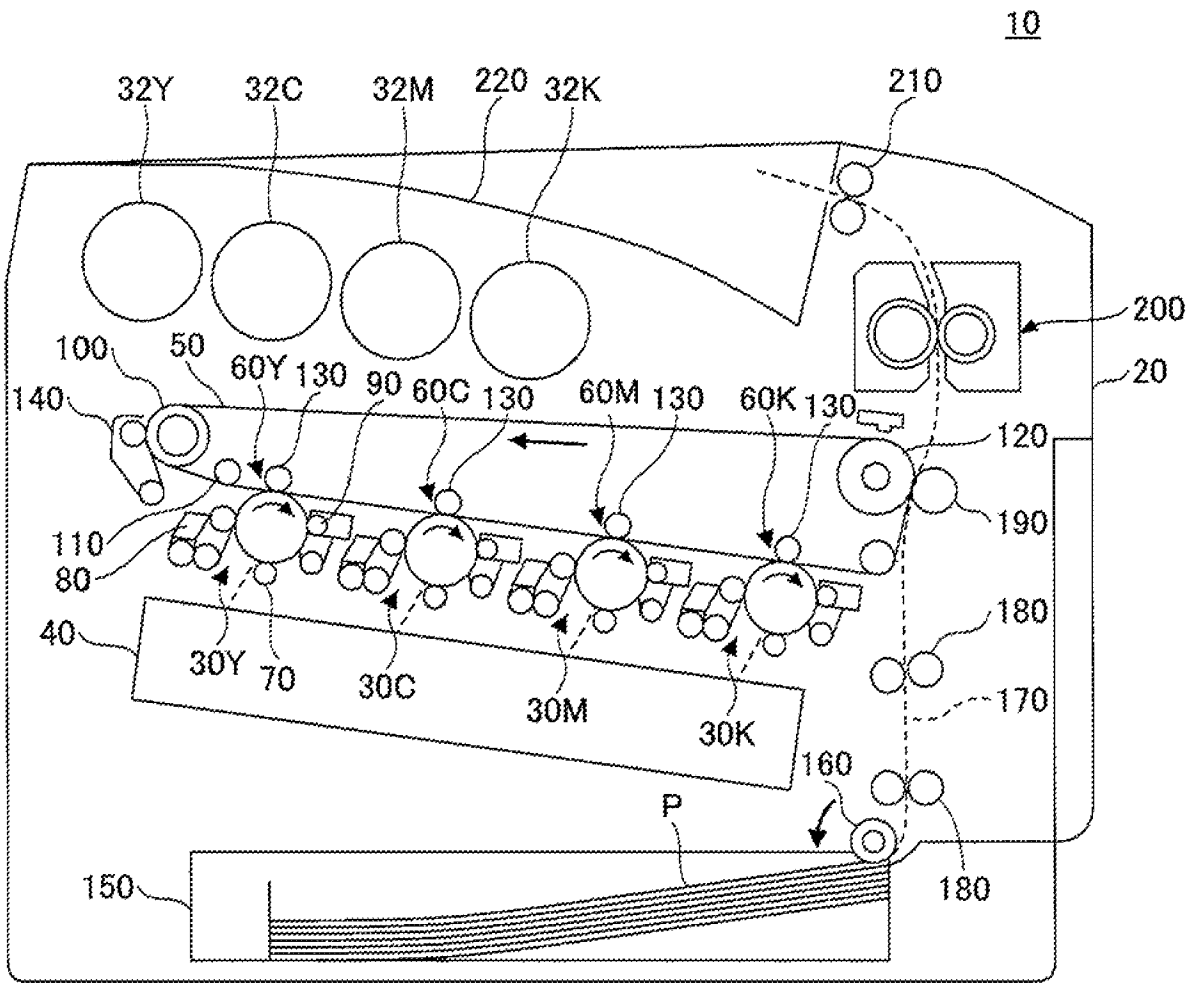
FIG. 1 illustrates an overall schematic configuration of an image forming apparatus including a fixing device according to an embodiment of the present invention.

FIG. 1 is a vertical sectional view indicating a schematic configuration of an image forming apparatus according to an embodiment of the present invention. As shown in FIG. 1, at the substantially center part inside a main unit case 20 of an image forming apparatus 10, there are four printer engines 30 (30Y, 30C, 30M, 30K), an optical writing device 40 that radiates light beams to scan photoconductors (described below), and an intermediate transfer belt 50. The printer engines (30Y, 30C, 30M, 30K) have the same configuration, and are for forming toner images. The printer engines 30Y, 30C, 30M, and 30K use toner of different colors respectively supplied from toner bottles 32Y, 32C, 32M, and 32K provided at an upper part to form toner images of different colors. In the descriptions and figures relevant to the printer engines 30Y, 30C, 30M, and 30K and the toner bottles 32Y, 32C, 32M, and 32K, the letters Y, C, M, and K accompanying the reference numerals stand for yellow, cyan, magenta, and black, respectively. These letters may be omitted as a matter of convenience.

The four printer engines 30Y, 30C, 30M, and 30K have the same mechanical structure. Each of the printer engines 30 includes a photoconductor 60 (60Y, 60C, 60M, 60K) that rotates in the direction indicated by the arrow, and a charging unit 70, a developing unit 80, and a cleaning unit 90 which are provided around the photoconductor 60 (60Y, 60C, 60M, 60K).

The photoconductor 60 (60Y, 60C, 60M, 60K) has a cylindrical shape that is rotated by a driving motor (not shown), and has a photosensitive layer provided on the outer peripheral surface. Light beams emitted from the optical writing device 40 radiate the outer peripheral surface of the photoconductor 60. Accordingly, an electrostatic latent image according to image data is written on the outer peripheral surface of the photoconductor 60 (60Y, 60C, 60M, 60K). The four photoconductors 60Y, 60C, 60M, and 60K include separate charging units 70, developing units 80, and cleaning units 90.

The charging unit 70 is a conductive roller member shaped as a roller. As a charging bias voltage is supplied to the charging unit 70 from a power source device (not shown), the outer peripheral surface of the photoconductor 60 is uniformly charged.

The developing unit 80 supplies toner to the photoconductor 60 (60Y, 60C, 60M, 60K). As the supplied toner adheres to the electrostatic latent image written on the outer peripheral surface of the photoconductor 60, the electrostatic latent image written on the photoconductor 60 is developed into a visual toner image.

The cleaning unit 90 cleans off the toner remaining on the outer peripheral surface of the photoconductor 60, after the toner image formed on the photoconductor 60 is transferred to the intermediate transfer belt 50.

The intermediate transfer belt 50 is a loop type belt formed by using a resin film or rubber as the base. A toner image formed on the photoconductor 60 is transferred onto the intermediate transfer belt 50. The intermediate transfer belt 50 is rotated in the direction indicated by the arrow by being supported by rollers 100, 110, and 120. On the inner peripheral side (inside of loop) of the intermediate transfer belt 50, there are four transfer rollers 130 for transferring the toner images on the photoconductor 60 onto the intermediate transfer belt 50. As the toner images formed on the photoconductors 60 are sequentially transferred onto the intermediate transfer belt 50, a color toner image is formed on the intermediate transfer belt 50. On the outer peripheral side (outside loop) of the intermediate transfer belt 50, there is provided a cleaning unit 140 for cleaning off toner and paper particles remaining on the outer peripheral side of the intermediate transfer belt 50.

Below the four printer engines 30Y, 30C, 30M, and 30K and the optical writing device 40 in the main unit case 20, there is provided a sheet feeding tray 150 in which recording media (printing sheets) P is stacked and stored. The sheets of the recording media P stacked and stored in the sheet feeding tray 150 are sequentially separated starting from the top sheet by a sheet feeding roller 160.

Inside the main unit case 20, there is formed a conveying path 170 (indicated by a dashed line in FIG. 1), along which the recording medium P separated from the sheet feeding tray 150 is conveyed. On the conveying path 170, there are provided resist rollers 180, a transfer roller 190, a fixing device 200, and sheet eject rollers 210.

The recording media P accommodated in the sheet feeding tray 150 is extracted one sheet at a time starting from the top sheet as the sheet feeding roller 160 rotates in the direction indicated by the arrow, and is conveyed to the conveying path 170.

As the resist rollers 180 are intermittently rotated at predetermined timings, the recording medium P that has been conveyed to and stopped at the resist rollers 180 is sent to the transfer position between the intermediate transfer belt 50 and the transfer roller 190, where the toner image on the intermediate transfer belt 50 is transferred to the recording medium P.

The fixing device 200 applies heat and pressure to the recording medium P onto which the toner image has been transferred, to fuse the toner and to fix the toner image onto the recording medium P.

After the recording medium P passes through the fixing device 200 upon undergoing the process of fixing the toner image, the recording medium P is ejected, by the sheet eject rollers 210, onto a sheet eject tray 220 formed on the top surface of the main unit case 20.

There are fixing devices using a heat roller method, an electromagnetic induction heating method, and a film heating method. In the following description of the fixing device 200, a fixing device using the heat roller method and a fixing device using the electromagnetic induction heating method are taken as examples.

The image forming apparatus 10 shown in FIG. 1 is an example of the present invention. An image forming apparatus includes devices such as a printer, a copier, and a fax machine. An image forming apparatus other than that shown in FIG. 1 may be used (for example, a device including a scanner unit, a double-sided printing mechanism, and an automatic document feeder). Furthermore, an image forming apparatus having an information terminal function that can be connected to a LAN (Local Area Network) or the Internet may be used.

Configuration of Fixing Device 200A

Figure 2A:
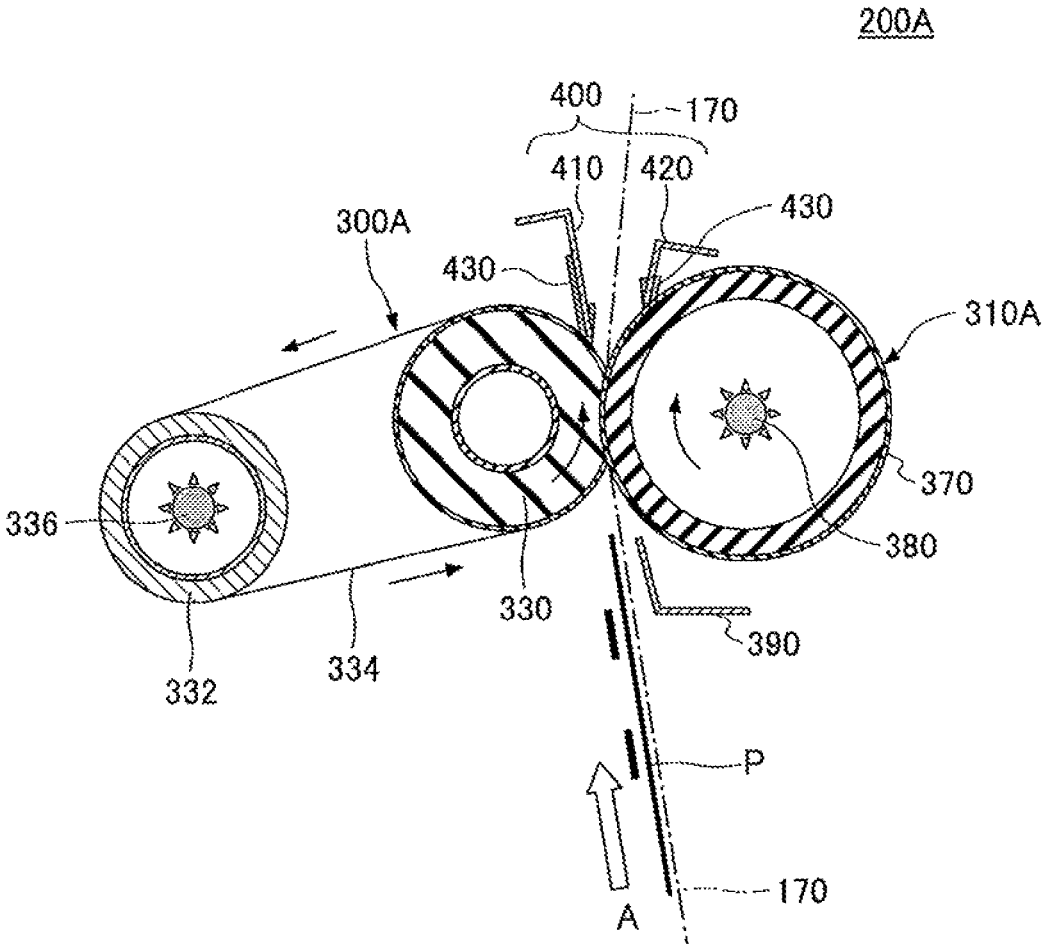
FIG. 2A is an enlarged view of a fixing device.

FIG. 2A is an enlarged view of a fixing device 200A. As shown in FIG. 2A, the fixing device 200A includes a fixing unit 300A and a pressurizing unit 310A. The fixing unit 300A includes a fixing roller (fixing member) 330, a heating roller 332, a fixing belt 334, and a heater 336.

The fixing belt 334 is wound around the outer periphery of the fixing roller 330 and the outer periphery of the heating roller 332. The heat of the heating roller 332 heated by the heater 336 is transferred to the recording medium P passing by the outer periphery of the fixing roller 330. The heater 336 provided at the center of the heating roller 332 is a heat source such as a halogen lamp.

The pressurizing unit 310A has a heater 380 provided inside a pressurizing roller (pressurizing member) 370. The heater 380 is a heat source such as a halogen lamp. The fixing roller 330 and the pressurizing roller 370 have an outer peripheral surface made of an elastic member such as rubber. The heat of the heater 336 and the heater 380 is transferred to the fixing belt 334 and the recording medium P via the elastic members.

The recording medium P on which the toner image has been transferred moves in a direction indicated by an arrow A in FIG. 2A, and receives heat and pressure when passing through the nip part formed between the fixing roller 330 and the pressurizing roller 370, so that the toner image is fixed.

Furthermore, on the upstream side of the fixing unit 300A and the pressurizing unit 310A in the conveying path 170, there is provided an inlet side guide member 390 for guiding the recording medium P in between the fixing roller 330 and the pressurizing roller 370. On the downstream side of the fixing unit 300A and the pressurizing unit 310A in the conveying path 170, there is provided an outlet side guide member 400.

The outlet side guide member 400 includes a first separating member 410 provided on the image side (side of the recording medium P on which an image is formed) for separating the recording medium P from the fixing roller 330 and a second separating member 420 provided on the non-image side (side of the recording medium P on which an image is not formed) for separating the recording medium P from the pressurizing roller 370.

The first separating member 410 and the second separating member 420 are formed of metal plates. Pushing members 430 are attached to the first separating member 410 and the second separating member 420. The pushing members 430 function as pushing units that contact the outer peripheral surfaces of the fixing roller 330 and the pressurizing roller 370 in a direction of a predetermined tilted angle. The pushing members 430 are rotatably disposed along the longitudinal directions of the fixing roller 330 and the pressurizing roller 370 in a plane parallel to the conveying plane of the conveying path 170 for conveying the recording medium P.

That is to say, the pushing member 430 is provided in a manner as to follow the surface characteristics of the outer peripheral surface at both ends of the fixing roller 330 or pressurizing roller 370, even if thermal expansion occurs and the diameters of the outer peripheral surface at both ends of the fixing roller 330 or pressurizing roller 370 become smaller than the diameter at the center part (in the longitudinal direction) of the fixing roller 330 or pressurizing roller 370.

Configuration of Fixing Device 200B

Figure 2B:
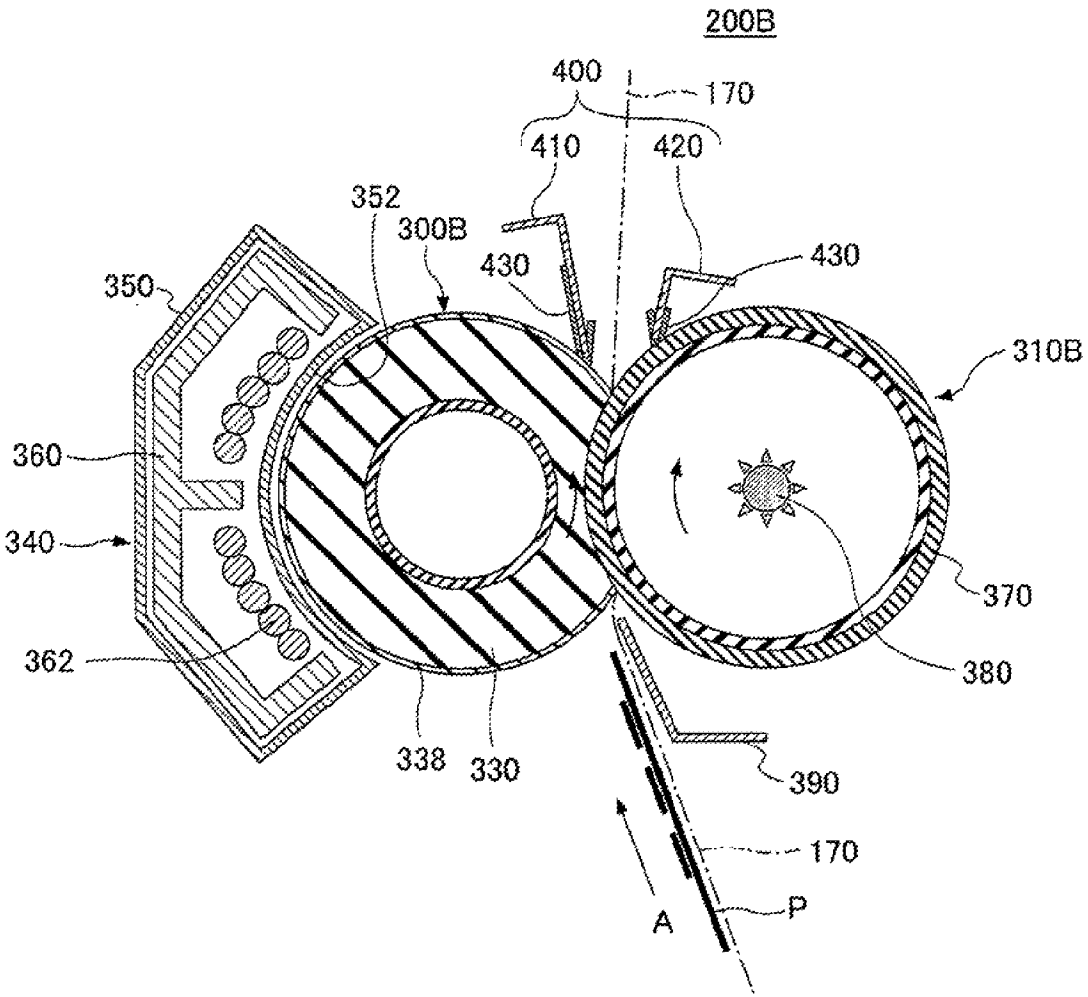
FIG. 2B is an enlarged view of a fixing device according to a modification.

FIG. 2B is an enlarged view of a fixing device 200B according to a modification. In FIG. 2B, elements corresponding to those in FIG. 2A are denoted by the same reference numerals and are not further described.

As shown in FIG. 2B, the fixing device 200B according to the modification includes a fixing unit 300B and a pressurizing unit 310B. The fixing unit 300B includes a heating unit 340 using an electromagnetic induction heating method, which is provided on the side of the fixing roller 330.

The heating unit 340 has a coil 362 wound around a core 360 in a housing 350. The housing 350 has an arc-shaped recess part 352 facing the outer peripheral surface of the fixing roller 330. When an electrical current is applied to the coil 362, an eddy current is induced to a metal layer (heat generating layer) of a fixing sleeve 338 forming the outer peripheral surface of the fixing roller 330, and the fixing sleeve 338 is heated by the Joule heat generated by the eddy current.

The pressurizing unit 310B has the same configuration as the pressurizing unit 310A.

Similar to the fixing device 200A, on the upstream side of the fixing unit 300B and the pressurizing unit 310B in the conveying path 170, there is provided the inlet side guide member 390. On the downstream side of the fixing unit 300B and the pressurizing unit 310B in the conveying path 170, there is provided the first separating member 410 and the second separating member 420 of the outlet side guide member 400.

Furthermore, the pushing members 430 are attached to the first separating member 410 and the second separating member 420.

The fixing device 200A and the fixing device 200B have different configurations; however, the fixing device 200A and the fixing device 200B may be selectively installed according to the configuration and the size of the internal space of the image forming apparatus 10. The fixing device 200A and the fixing device 200B are also applicable to image forming apparatuses other than the image forming apparatus 10 shown in FIG. 1.

Configuration of Pushing Member 430

Figure 3A:
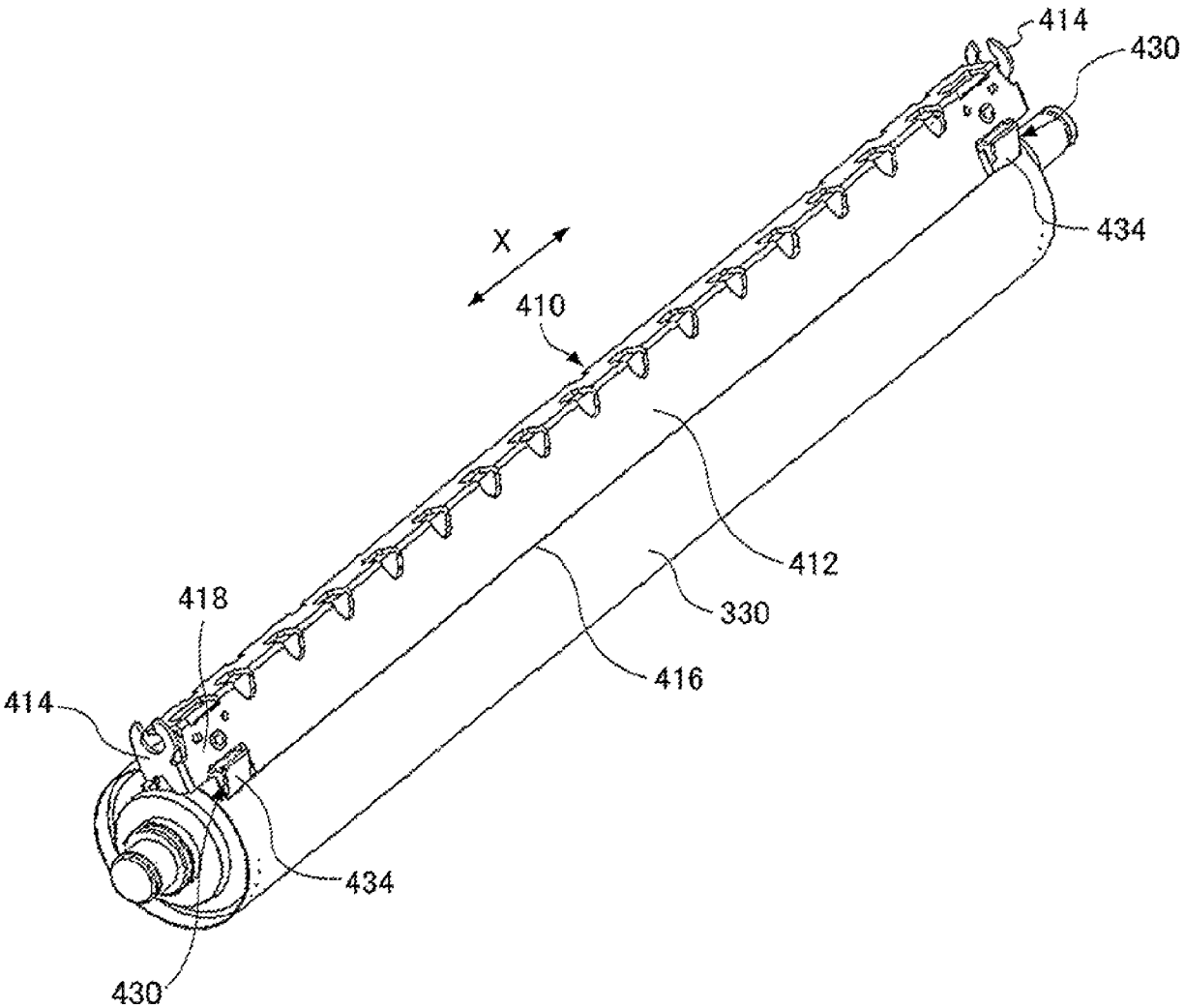
FIG. 3A is a perspective view indicating the positional relationships between a roller, a separating member, and pushing members.
Figure 3B:
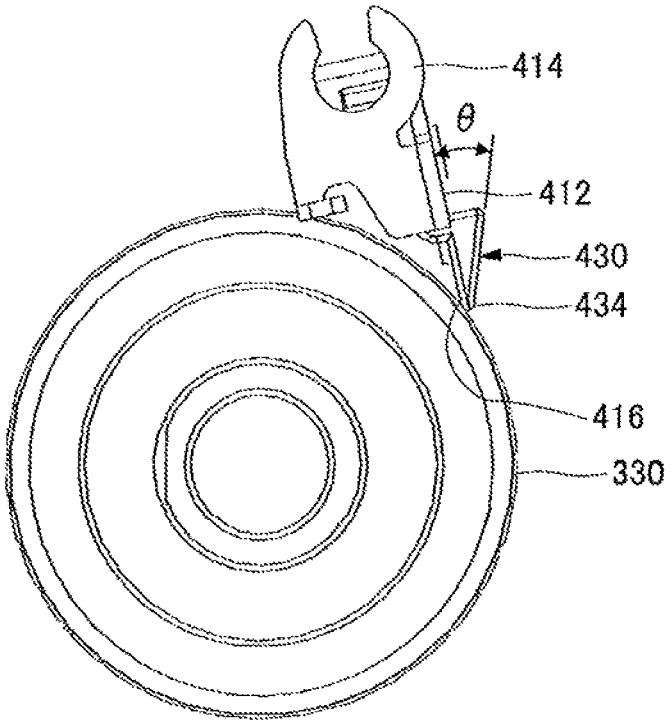
FIG. 3B is a side view indicating the positional relationships between a roller, a separating member, and a pushing member.
Figure 3C:
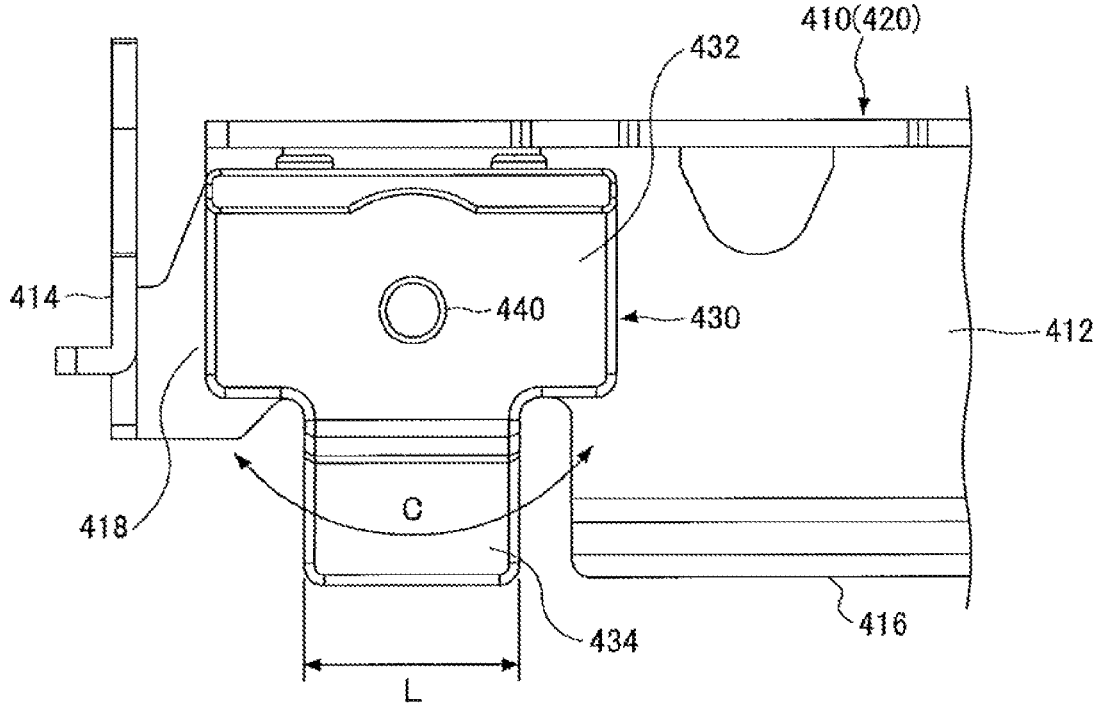
FIG. 3C is an enlarged view of the attached pushing member.

FIG. 3A is a perspective view indicating the positional relationships between the fixing roller 330 and the first separating member 410 and the pushing member 430. FIG. 3B is a side view indicating the positional relationships between the fixing roller 330 and the first separating member 410 and the pushing member 430. FIG. 3C is an enlarged view of the attached pushing member 430. The configuration of the pushing member 430 attached to the first separating member 410 is the same as that attached to the second separating member 420, and therefore a description is given of the pushing member 430 attached to the first separating member 410.

As shown in FIGS. 3A through 3C, the first separating member 410 includes a separating plate 412 extending in the longitudinal direction (X direction) of the fixing roller 330 (or pressurizing roller 370), and a pair of pushing members 430 provided on both ends of the separating plate 412 in the longitudinal direction.

The separating plate 412 is supported by a pair of brackets 414 at both ends. The separating plate 412 includes an edge part 416 facing the outer peripheral surface of the fixing roller 330 (or pressurizing roller 370) with a predetermined separation gap therebetween.

Furthermore, the fixing roller 330 (or pressurizing roller 370) has a small diameter for the purpose of reducing the thermal capacity. Thus, the pushing member 430 slides against the same part of the fixing roller 330 (or pressurizing roller 370) many times.

As contact parts 434 contact the outer peripheral surface of the fixing roller 330 (or pressurizing roller 370), a predetermined separation gap is formed between the edge part 416 of the separating plate 412 and the outer peripheral surface of the fixing roller 330 (or pressurizing roller 370), so that the distance between the edge part 416 and the fixing roller 330 (or pressurizing roller 370) is adjusted.

As shown in FIG. 3B, the separating plate 412 is attached such that the edge part 416 faces the outer peripheral surface of the fixing roller 330 (or pressurizing roller 370) from a substantially tangential direction. The edge part 416 of the separating plate 412 faces the outer peripheral surface of the fixing roller 330 (or pressurizing roller 370) with a predetermined separation gap therebetween, and therefore the edge of the recording medium P passing through the nip part can be separated from the fixing roller 330 (or pressurizing roller 370).

As shown in FIG. 3C, each pushing member 430 includes a holding part 432 that is rotatably held by an attaching part 418 of the edge part 416 of the separating plate 412, and a contact part 434 that protrudes downward from the center portion of the holding part 432. The holding part 432 is wider than the contact part 434, and is rotatably supported by a shaft 440 from behind the attaching part 418 of the separating plate 412.

The contact part 434 of the pushing member 430 has a predetermined pushing width L in the longitudinal direction (X direction) of the fixing roller 330 (or pressurizing roller 370). As the holding part 432 is rotatably supported, even if the outer periphery of the fixing roller 330 (or pressurizing roller 370) deforms into a so-called "drum shape" due to thermal expansion, the contact width of the pushing member 430 and the outer periphery of the roller is maintained.

As shown in FIG. 3B, the contact part 434 of the pushing member 430 is tilted by a predetermined angle θ with respect to the edge part 416 of the separating plate 412. Furthermore, the contact part 434 contacts the outer peripheral surface of the fixing roller 330 (or pressurizing roller 370) in a direction that is at a predetermined angle θ with respect to the separating plate 412. Thus, even if the outer peripheral surface at both ends of the fixing roller 330 (or pressurizing roller 370) deforms due to thermal expansion, the end parts of the contact part 434 contact the outer peripheral surface of the fixing roller 330 (or pressurizing roller 370), so that the pushing member 430 can easily swing in a manner as to follow the surface characteristics of the fixing roller 330 (or pressurizing roller 370).

Function of Pushing Member 430

Figure 4A:
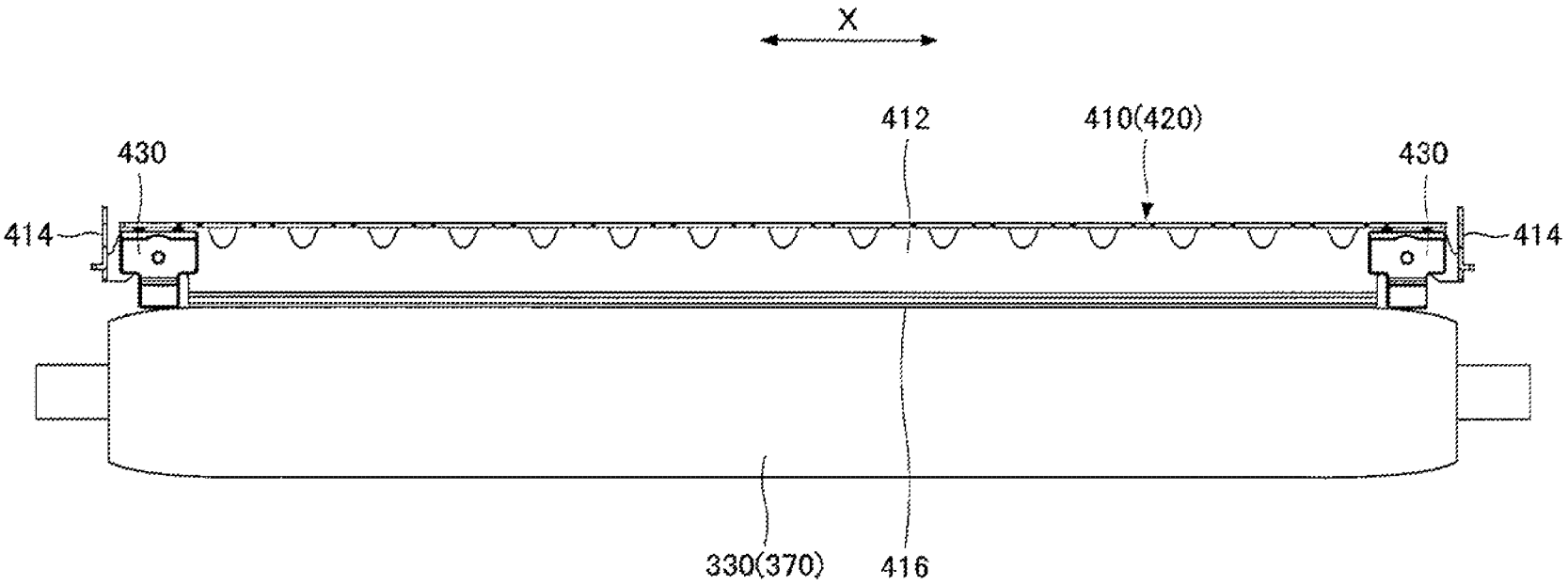
FIG. 4A illustrates the positional relationship between a separating member and pushing members when the roller has deformed into a drum shape.

FIG. 4A illustrates the positional relationship between the separating plate 412 and the pushing members 430 when the roller has deformed into a drum shape. As shown in FIG. 4A, the fixing roller 330 (or pressurizing roller 370) is rapidly heated, and therefore the thermal expansion may not occur in a uniform manner in the longitudinal direction (X direction), particularly immediately after activation or after sheets of small sizes have continuously passed through the rollers. Generally, the center part of the roller in the longitudinal direction becomes larger than the end parts, and the roller tends to become shaped like a drum.

Figure 4B:
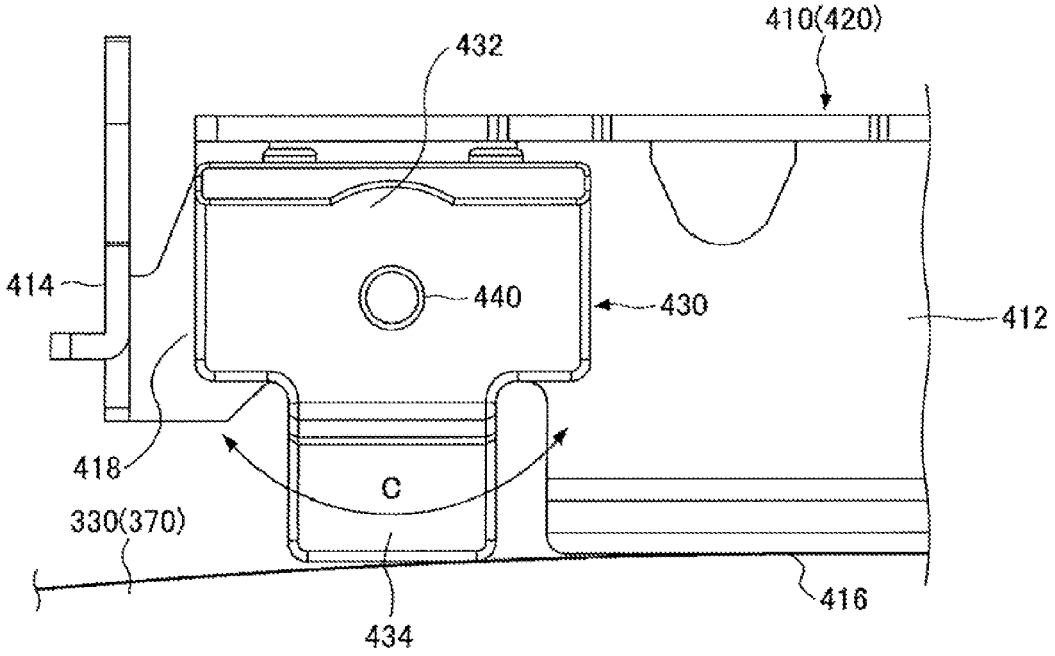
FIG. 4B is an enlarged view of the operation of the pushing member when the roller has deformed into a drum shape.

FIG. 4B is an enlarged view of the operation of the pushing member 430 when the roller has deformed into a drum shape. As shown in FIG. 4B, the pushing member 430 is rotatably held by the shaft 440 with respect to the attaching part 418 of the separating plate 412. Therefore, when the extent of thermal expansion of the outer peripheral surface of the fixing roller 330 (or pressurizing roller 370) varies along the longitudinal direction (X direction), the contact part 434 rotates in the C direction so that corners of the contact part 434 contact the outer peripheral surface of the roller, and the leading edge of the contact part 434 contacts the outer peripheral surface of the roller that has deformed into a drum shape.

That is to say, parts (corners) of the leading edge of the contact part 434 contact the outer peripheral surface of the fixing roller 330 (or pressurizing roller 370) and the contact part 434 swings, and therefore the pushing member 430 can secure a contact width on the outer peripheral surface of the fixing roller 330 (or pressurizing roller 370).

As described above, in the pushing member 430, the leading edge of the contact part 434 follows the variation in the shape of the outer peripheral surface of the fixing roller 330 (or pressurizing roller 370). Therefore, the contact part 434 can push against the outer periphery of the roller by a predetermined contact pressure along the longitudinal direction (X direction). Thus, even if the outer peripheral surface of the fixing roller 330 (or pressurizing roller 370) deforms into a drum shape having a large diameter at the center part in the longitudinal direction and a small diameter at both ends in the longitudinal direction, the contact part 434 follows the outer peripheral surface of the roller so that the contact part 434 pushes against the roller with a predetermined contact width. Therefore, the outer peripheral surface of the roller is prevented from being damaged.

Furthermore, in the pushing member 430, the contact part 434 rotates in a manner as to follow the outer peripheral surface of the roller when the outer peripheral surface of the fixing roller 330 (or pressurizing roller 370) deforms due to thermal expansion. Thus, the contact width of the contact part 434 on the fixing roller 330 (or pressurizing roller 370) varies (is not uniform) due to the relative displacement in the width direction of the pushing force.

Furthermore, in the case of the electromagnetic induction heating method, as shown in FIG. 2B, the fixing sleeve 338 having a metal layer is applied on the outer periphery of the fixing roller 330. The pushing member 430 rotates in the C direction to prevent a situation where only the corners of the contact part 434 are contacting the fixing sleeve 338. Therefore, damage of the fixing sleeve 338 can be mitigated.

Modification 1 of Pushing Member 430

Figure 5A:
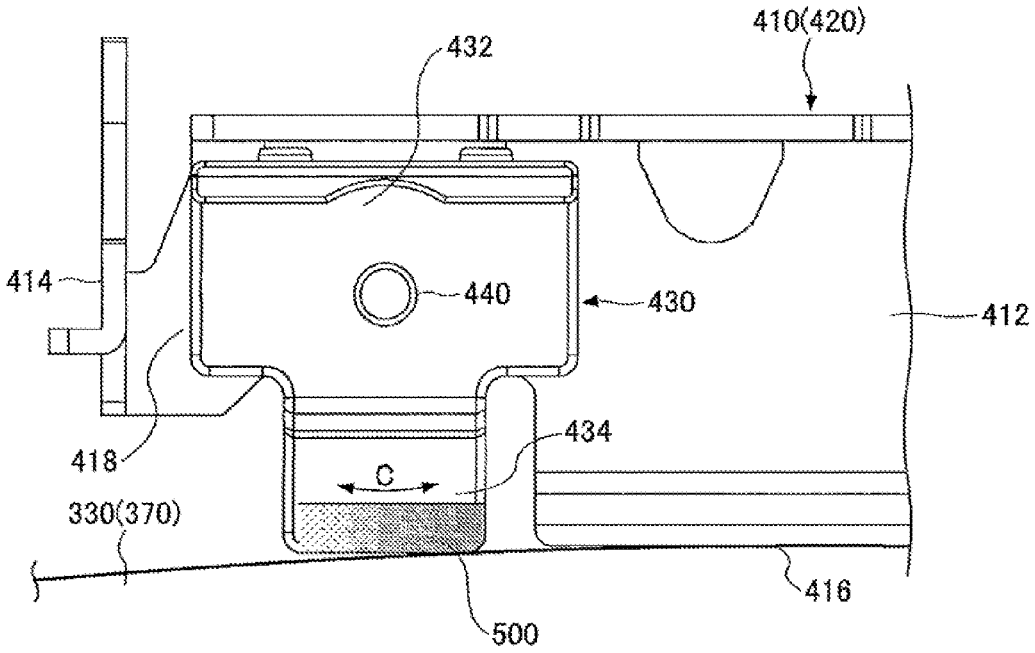
FIG. 5A illustrates a modification 1 of a coating layer of the pushing member.

FIG. 5A illustrates a modification 1 of the coating layer of the pushing member 430. As shown in FIG. 5A, a pushing member 430 according to modification 1 has a coating layer 500 provided on the surface of the contact part 434 for the purpose of lubrication. The coating layer 500 is formed of a thin film having a low friction coefficient, such as tetrafluoroethylene resin and plating.

Furthermore, the thickness of the coating layer 500 is not uniform across the entire contact part 434. The coating layer 500 is thin at the end part (end part on left side in FIG. 5A), where the contact part 434 is less likely to contact the roller when the outer peripheral surface of the fixing roller 330 (or pressurizing roller 370) deforms into a drum shape. Meanwhile, the coating layer 500 is thick at the end part (end part on right side in FIG. 5A), where the contact part 434 is more likely to contact the roller. That is to say, the closer to the center part of the roller where the contact part 434 is more likely to contact the fixing roller 330 (or pressurizing roller 370), the thicker the coating layer 500. The coating layer 500 has the maximum thickness at the end part (end part on right side in FIG. 5A) located closer to the center of the roller where the contact part 434 is most likely to contact the roller. Therefore, even when the outer peripheral surface of the fixing roller 330 (or pressurizing roller 370) thermally expands, the resistance can be reduced when the contact part 434 contacts the outer peripheral surface of the fixing roller 330 (or pressurizing roller 370), and the operating life of the coating layer 500 can be extended.

Modification 2 of Pushing Member 430

Figure 5B:
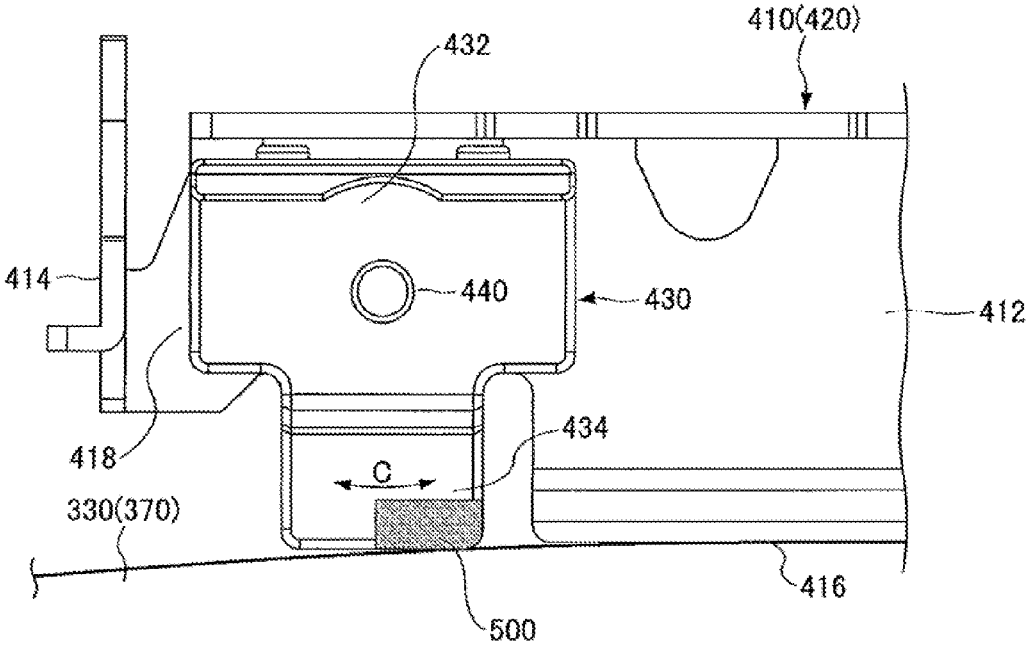
FIG. 5B illustrates a modification 2 of the coating layer of the pushing member.

FIG. 5B illustrates a modification 2 of the coating layer 500 of the pushing member 430. As shown in FIG. 5B, the pushing member 430 according to modification 2 has the coating layer 500 provided on the leading edge of the contact part 434 for the purpose of lubrication.

The coating layer 500 is only formed at the end part (end part on right side in FIG. 5A) extending from the center of the horizontal width of the contact part 434 toward the center of the roller where the contact part 434 is more likely to contact the roller when the outer peripheral surface of the fixing roller 330 (or pressurizing roller 370) deforms into a drum shape. That is to say, on the contact part 434, the coating layer 500, which is used for the purpose of lubrication, is only formed along a predetermined width at the end part closer to the center of the fixing roller 330 (or pressurizing roller 370) in the longitudinal direction.

The coating layer 500 is formed on the right half or the left half of the contact part 434 where the contact part 434 is most likely to contact the roller when the outer peripheral surface of the fixing roller 330 (or pressurizing roller 370) thermally expands. Therefore, the resistance can be reduced when the contact part 434 contacts the outer peripheral surface of the fixing roller 330 (or pressurizing roller 370).

Modification 3 of Pushing Member 430

Figure 5C:
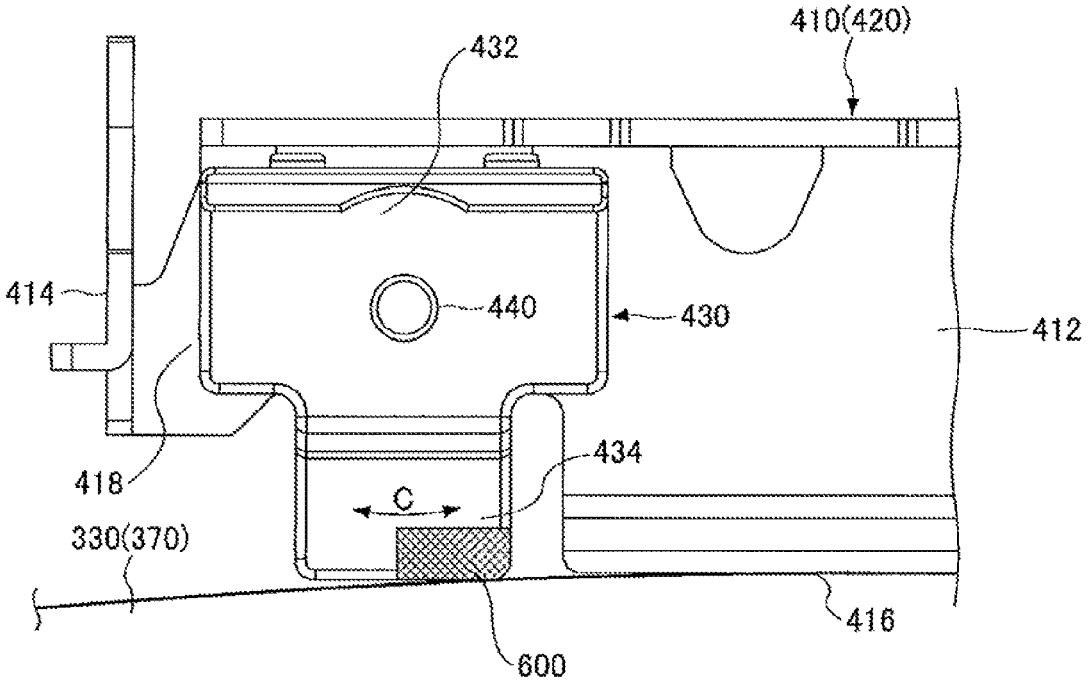
FIG. 5C illustrates a modification 3 in which another member is attached to the contact part of the pushing member.

FIG. 5C illustrates a modification 3 in which another member is attached to the edge of the pushing member 430. As shown in FIG. 5C, the pushing member 430 according to modification 3 has a sliding contact member 600 provided at the edge part of the contact part 434 for the purpose of lubrication.

The sliding contact member 600 is formed of a relatively soft material such as rubber or resin. The sliding contact member 600 is only fixed to the end part (on right half in FIG. 5C) extending from the center of the horizontal width of the contact part 434 toward the center of the roller where the contact part 434 is likely to contact the roller when the outer peripheral surface of the fixing roller 330 (or pressurizing roller 370) deforms into a drum shape.

The sliding contact member 600 is formed on the right half or the left half of the contact part 434 of the pushing member 430 where the contact part 434 is most likely to contact the roller when the outer peripheral surface of the fixing roller 330 (or pressurizing roller 370) thermally expands. Therefore, the resistance can be reduced when the contact part 434 contacts the outer peripheral surface of the fixing roller 330 (or pressurizing roller 370).

In the above embodiments, examples are given of the printer engines 30Y, 30C, 30M, and 30K that perform color printing; however, the present invention is also applicable to examples where monochrome printing is performed.

In the above embodiments, examples are given of the image forming apparatus 10 having the sheet feeding tray 150; however, the present invention is not so limited. The present invention is also applicable to a printer or a fax machine in which three to four sheet feeding trays are accommodated in the main unit.

In the above embodiments, examples are given of a conveying path that curves like an ark as shown in FIG. 1; however, the conveying path of the present invention is not limited to the conveying path 170 described above, and another type of path may be included.

According to an embodiment of the present invention, the pushing unit of the guide member follows the surface characteristics of the outer peripheral surface of the fixing member or the pressurizing member. Therefore, when the outer peripheral shape of the fixing member or the pressurizing member is not uniform when the fixing device is heated at the time of activation or when a toner image on a small-sized recording medium is fixed, etc., the separation gap (between the guide member and the roller) can be maintained at a predetermined value in a manner as to follow the outer peripheral shape of the fixing member or the pressurizing member, and a recording medium that has passed through the fixing member and the pressurizing member can be stably guided into a direction to be separated from the fixing member and the pressurizing member.

The present invention is not limited to the specific embodiments described herein, and variations and modifications may be made without departing from the scope of the present invention. The present application is based on Japanese Priority Patent Application No. 2011-030624, filed on Feb. 16, 2011, the entire contents of which are hereby incorporated herein by reference.

What is claimed is:

1. A fixing device comprising:

a fixing member configured to heat a toner image on a recording medium and fix the toner image onto the recording medium;

a pressurizing member configured to press a heating member, which is used to heat the fixing member, against the fixing member and form a fixing nip part; and a guide member configured to guide the recording medium away from the fixing member and the pressurizing member at a downstream side of the fixing member or the pressurizing member in a conveying direction of the recording medium, wherein the guide member includes a pushing unit to maintain a relative positional relationship between the guide member and an outer peripheral surface of the fixing member or the pressurizing member, the pushing unit is provided in a manner as to follow surface characteristics of outer peripheral parts of the fixing member or the pressurizing member where the pushing unit pushes, the pushing unit is a pushing member that is a separate member from the guide member and attached to edge parts of the guide member, the pushing member being in close contact with the outer peripheral surface of the fixing member or the pressurizing member, the pushing member is rotatably disposed along a longitudinal direction of the fixing member or the pressurizing member, within a plane parallel to a conveying plane in which the recording medium is conveyed in the guide member, and the pushing unit adjusts a distance between the guide member and the fixing member or the pressurizing member, such that the guide member is spaced away from the outer peripheral surface of the fixing member or the pressurizing member by a predetermined separation gap.

2. The fixing device according to claim 1, wherein the guide member includes a first separating member configured to separate the recording medium from the fixing member, and a second separating member configured to separate the recording medium from the pressurizing member, wherein both the first separating member and the second separating member are respectively provided with the pushing unit.

3. The fixing device according to claim 1, wherein the pushing unit includes a pushing width that contacts the fixing member or the pressurizing member in a direction parallel to a longitudinal direction of the fixing member or the pressurizing member, and the pushing unit is formed such that a contact width extending along a direction of the pushing width is not uniform with respect to the fixing member or the pressurizing member.

4. The fixing device according to claim 3, wherein the pushing unit includes a coating layer for lubrication, and the coating layer has a thickness that gradually increases in the direction of the pushing width toward a center part of the fixing member or the pressurizing member in the longitudinal direction.

5. The fixing device according to claim 3, wherein the pushing unit includes a coating layer for lubrication, and the coating layer is provided only at a predetermined partial width part in the direction of the pushing width, the predetermined partial width part being close to a center part of the fixing member or the pressurizing member in the longitudinal direction.

6. The fixing device according to claim 3, wherein the pushing member includes a sliding contact member made of a soft material provided at least at a part that contacts the recording medium in the direction of the pushing width.

7. An image forming apparatus comprising the fixing device according to claim 1.

* * * * *